United States Patent [19]

Haddock

[11] Patent Number: 4,716,947

[45] Date of Patent: Jan. 5, 1988

[54] ALL WEATHER SOFT-SIDED CARRIER SYSTEM

[76] Inventor: Sharon K. Haddock, 2554 S. Eagle St., Aurora, Colo. 80014

[21] Appl. No.: 816,427

[22] Filed: Jan. 6, 1986

[51] Int. Cl.[4] ..... A45C 3/08; A45C 13/10; A45C 13/12

[52] U.S. Cl. ..... 150/106; 150/105; 150/52 E; 150/127; 190/26; 383/111

[58] Field of Search ..... 150/100, 103–106, 150/52 E, 52 F, 127; 383/111; 190/26, 100; 206/45.34

[56] References Cited

U.S. PATENT DOCUMENTS

| | | | |
|---|---|---|---|
| D. 108,279 | 2/1938 | Felmann | 150/127 X |
| 1,647,169 | 11/1927 | Anton | 150/52 F |
| 2,096,895 | 10/1937 | Halpin | 383/14 |
| 2,130,019 | 9/1938 | Meier | 206/45.34 |
| 2,437,382 | 3/1948 | Czap | 150/105 |
| 3,121,452 | 2/1964 | Hyman | 150/127 |
| 3,349,992 | 10/1967 | Skinner | 150/52 E |
| 3,550,663 | 12/1970 | Johnston | 150/103 |
| 3,826,296 | 7/1974 | Morris | 383/111 |
| 4,026,339 | 5/1977 | Burke | 150/106 X |
| 4,112,991 | 9/1978 | Barbaresi | 150/104 |
| 4,350,194 | 9/1982 | Brown | 190/110 X |

FOREIGN PATENT DOCUMENTS

| | | | |
|---|---|---|---|
| 548626 | 10/1922 | France | 190/26 |
| 1059597 | 10/1953 | France | 383/111 |

*Primary Examiner*—William Price
*Assistant Examiner*—Sue A. Weaver
*Attorney, Agent, or Firm*—Joseph C. Herring

[57] ABSTRACT

A weather-resistant carrier is made up of a non-waterproof bag and waterproof accessories. The accessories are a bottom container, a cap, and a sheath with handles similar to those of the bag covering a major portion of the sides of the bag. One or all may be connected directly to the bag. Preferably, the bottom container is attached to the bag, the sheath attached to the bottom container, and the cap to the sheath. In a preferred model, the sheath can be folded up with the empty bag, placed in the container, and the cap can be attached to the container to provide a carrying case. All or parts of the accessories can be utilized with the bag, depending on the weather.

19 Claims, 6 Drawing Figures

ALL WEATHER SOFT-SIDED CARRIER SYSTEM

BACKGROUND OF THE INVENTION

Many carriers have been created for special uses through the years. Typical of these are bags for skis, photographers' equipment, food for nursing babies, and the like. New opportunities create new bag designs. Outdoor sporting events have created an unique need for a bag that provides: identity with the team and large capacity for binoculars, blankets, seat cushions, rain gear, flasks, noise makers, etc. Additionally, the bag must fold into a small volume when its contents are emptied. It must also be capable of protecting its contents under all weather conditions.

Many bags have been designed using the using plastics, synthetic fibers, natural fibers, and combinations of these fibers. Cloth bags are less than ideal because they get soiled rapidly in normal usage. Bags of synthetic fibers work well and soil less rapidly but do not protect their contents during driving rainstorms or the like. Plastic bags also have their problems; for example, they can become very stiff in cold weather and may crack or tear more easily. Further, plastics generally tend to tear at points of stress, i.e., where the handles are attached and to stretch unacceptably at such points, particularly in hot weather.

The solution to these problems is the use of a combination of a cloth bag and a plastic bag. The cloth provides the needed strength, and the plastic provides the needed protection.

The closest analogy to the bags designed for use by spectators at sporting events is probably shopping bags. Thus, U.S. Pat. No. 3,349,992 issued to R. T. Skinner describes a combination of a plastic bag with a shopping bag where the plastic bag is inverted and has two slots cut in the "bottom" of the bag through which the handles of the shopping bag project when the plastic hood is slipped over the shopping bag. This, however, does not protect the normal rattan or jute handles of commercial shopping bags which tend to weaken when wet. The bag of this invention overcomes even that problem.

In shipping materials such as cement, the goods are sewn into inner multi-layer bags of paper or plastic-treated paper and an outer layer of plastic under conditions wherein materials within the bag would destroy the plastic and external moisture would destroy the paper. Similarly, chemicals of various types have been placed in plastic bags which act as liners for fiber pack drums. In still other uses, the material to be shipped is placed within a plastic liner and an outer paper bag. In some situations there may be still another external plastic layer.

SUMMARY OF THE INVENTION

The weather-resistant carriers of this invention are made up of a non-waterproof fabric bag and waterproof accessories. The accessories are a bag container, a cap, and a sheath with handles similar to those of the bag. One or all may be connected directly to the bag. Preferably, the container is attached to the bag, the sheath attached to the container, and the cap to the sheath. In a preferred model, the sheath can be folded up with the empty bag, placed in the container, and the cap attached to the container to provide a carrying case. All or parts of the accessories can be utilized with the bag, depending on the weather.

SPECIFIC DESCRIPTION OF THE DRAWINGS

Figures 1, 2, 3, 4, 6:
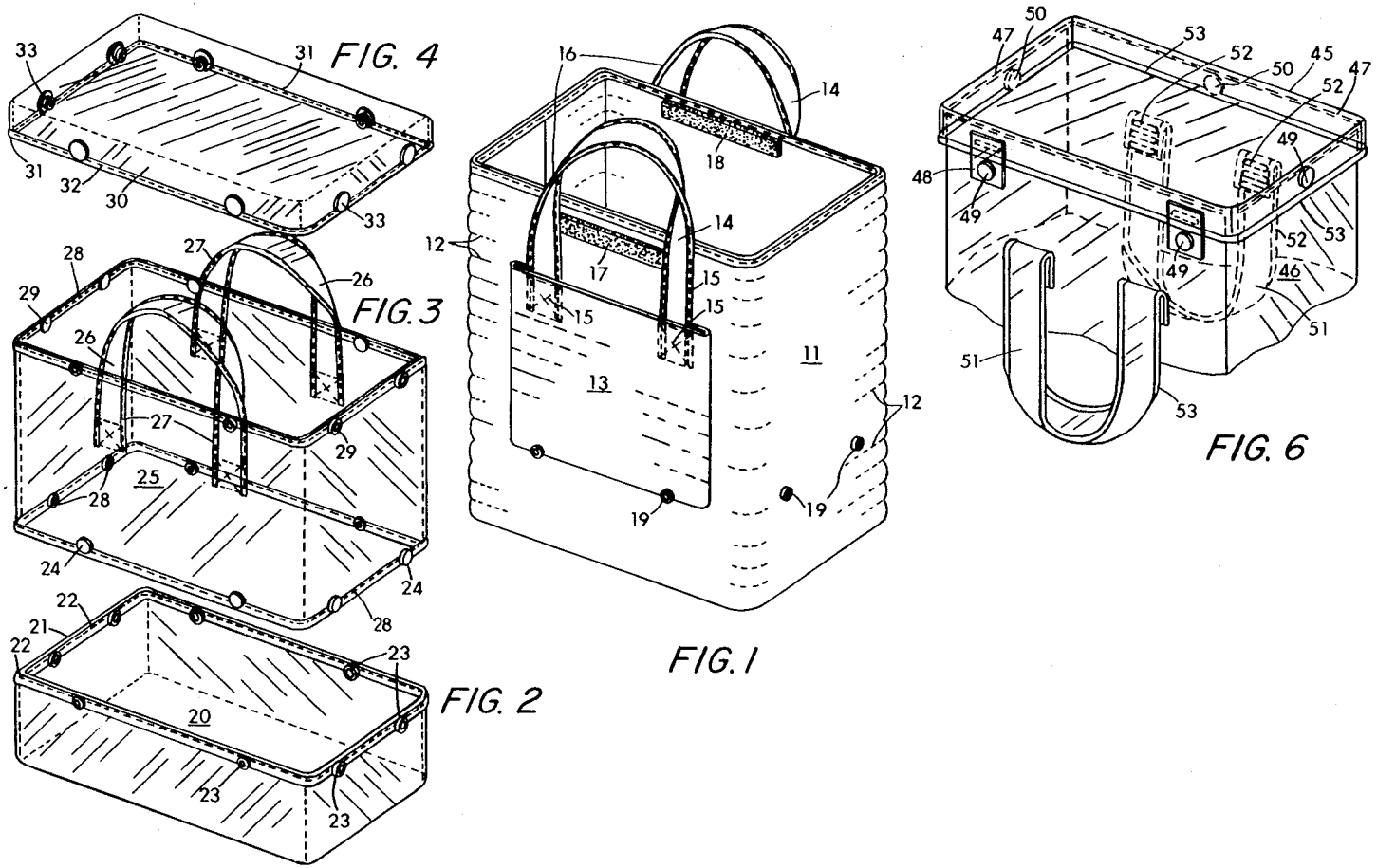
FIG. 1 depicts a bag made of a light, cotton quilting, having a decorative trim.
FIG. 2 depicts a plastic container to be attached to the bottom of the bag.
FIG. 3 depicts a sheath designed to cover the upper portion of the bag.
FIG. 4 depicts a cap to be fitted over and attached to the sheath.
FIG. 6 depicts a hinge-type attachment of the cap to the sheath.

In the embodiment of FIG. 1, bag 11 is made of a cotton quilting, as indicated by solid and dashed lines 12. Pockets 13 of this same material are sewn on each side of the bag 11. Handles 14 are sewn to the upper portion of bag 11 in a manner which permits the entire handles 14 to be hidden when they are placed in pockets 13. Stitching 15 denotes all sewing. Bias tape edging 16 of a desired highlight color is sewn to the upper edge of bag 11 and each edge of handles 14. Hook and pile fastener halves 17 and 18 (Velcro) are positioned to hold the folded upper portion of bag 11 in a closed position. Snap fastener halves 19 are attached to the four sides of bag 11.

FIG. 2 shows a container 20 which is made up of a clear vinyl plastic. Bias tape edging 21 is attached by stitches 22 around the upper portion of container 20. Double snap fastener halves 23 are affixed to the upper portion of container 20 and are positioned for attachment to the fastener halves 19 of FIG. 1 and the bottom snap fasteners 24 of FIG. 3. Container 20 has a slightly greater length and breadth than bag 11 of FIG. 1, so that bag 11 effectively reduces or eliminates the transmission of the pressure by the bag's contents against the bag side on the container.

FIG. 3 shows a series of snap fasteners 24 around the bottom of sheath 25. Sheath 25 is made of a clear vinyl plastic and has handles 26 of a heavier gauge of the same material. Both sheath 25 and handles 26 have an edging 27 covering their respective upper and lateral edges. Edging 27 is held in place by stitches 28. Snap fastener halves 24 are positioned to snap onto the snap fastener halves 23 of FIG. 2. Sheath 25 is large enough to fit around bag 11 of FIG. 1, and at its bottom edge, at least, is larger than the upper edge of container 20 of FIG. 2. Sheath 25 is made of a sufficiently heavy gauge vinyl plastic to resist any tendency of handles 26 to pull away from sheath 25 when bag 11 is loaded and all of the weight is supported by handles 26.

FIG. 4 shows a clear vinyl cap 30 with edging 31 held in place by stitches 32. The cap 30 is large enough to cover bag 11 of FIG. 1 when the top of bag 11 is held in a closed position by hook and pile fasteners 17 and 18 of FIG. 1 and to fit over the upper edge of sheath 25 and permit fastening of snap fasteners 33 onto fastener halves 29 of FIG. 3. A handle (not shown) can be attached to the top of cap 30 in any manner which does not reduce the water resistance of the cap 30.

Figure 5:
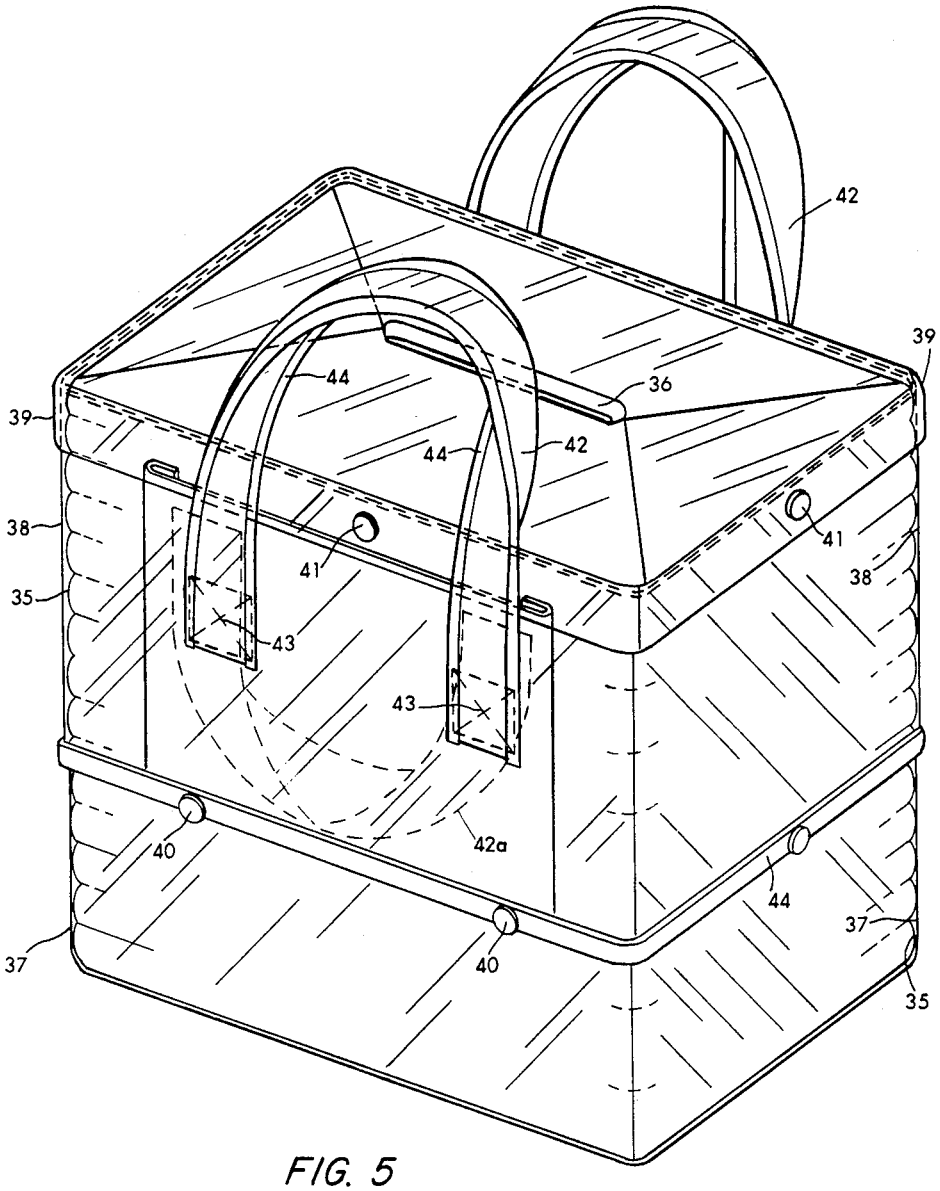
FIG. 5 depicts the bag of FIG. 1 enclosed by a plastic container, sheath, and cap.

FIG. 5 shows the bag 35 with its top edging covered edges 36 folded into a closed position and encased in a clear container 37, sheath 38 and cap 39. Snap fasteners 40 hold sheath 38 on container 37 and, in turn, hold container 37 to bag 35. Snap fasteners 41 affix cap 39 over the top of bag 35 while attaching it to sheath 38. Handles 42 have stitches 43 attaching them to sheath 38 and edging 44 is shown on the edges of container 37 and handles 42. Handles 42*a*, indicated by dashed lines, are shown in place within a pocket (unnumbered) on the side of bag 35.

FIG. 6 is a partial cutaway view depicting a form of hinged cap 45. The cap 45 is attached to a sheath 46 with a space between the upper surface of cap 45 and the upper edge 47 of sheath 46. Both are made of transparent plastic. On the near side, cap 45 has two depending tabs 48 with snap fastener halves 49 attached to fastener halves 50 of sheath 46. Tabs 48 combine with cap 45 and sheath 46 to provide a hinged side and a good closure. Handles 51 are shown hanging from their points of attachment by fusion bands 52. All plastic edges 53 are formed by folding the plastic into multiple layers and fusing the plastic.

As depicted, the carriers of this invention can be made in various forms. In general, the bags will be made of a durable fabric, i.e., nylon, cotton or linen; and may even be made of leather. The seams of the bag can be stapled, glued, sewn or fused, or combinations of the above. The bag may even be made of a netting or perforated material to increase air flow. It should be remembered, however, that the bag is intended to be the primary support for the contents of the bag and minimal stress is intended to be placed upon the plastic accessories. The edging for the bags can be made of either natural or synthetic fibers and can even be a flexible plastic, i.e., polyvinyl chloride film.

The edging will normally be in an accent color to set off the color or colors of the bag. All or parts of the bag can be of one or many colors, and, where leather is utilized, can have designs printed or tooled onto its surface. It can also have pockets for identification windows, etc.

The accessories will generally be made of a flexible plastic film of the types previously mentioned. The film can be reinforced by fusion with additional thicknesses of the film at points where attachments are to be made, and, where the bag does not completely eliminate stress to the accessories, the accessories may have vertical, horizontal, or other reinforcing thickening or straps. Preferably, the accessories are transparent.

The edging of the accessories, where used, should add to the overall aesthetic design. Normally, the edging will be a heavier gauge of the plastic film, but can be portions of the film which have been folded over and fused.

The container and cap can be of an inflexible plastic material. Inflexible materials suitable for the manufacture of such containers and caps include polystyrene, polyolefins, and ABS plastic. The accessories and particularly the handles are preferably polyester or other spatially stable plastic material.

The drawings show the use of snaps to achieve the attachment of the container to the bag and attachment of the cap to the sheath and the sheath to the containers. Other attachment devices can be utilized; for example, hook and pile fasteners, zippers, and other closures known to the luggage art. Both the bag and the accessories may be formed into a locked system using a soft luggage locking device.

The seams of both the bag and the accessories can be stapled, glued, sewn or fused or combinations of the above. The bag may have a flap opening rather than being closed as indicated in FIG. 5. Similarly, the tab hinges of FIG. 6 can extend all the way across one side to provide an effective flap over the top of the sheath.

The accessories can be opaque, translucent, transparent, or any combination of the above. Parts of the carrier can be colored or white and can have designs printed, tooled or molded into its surfaces. It can also have pockets with identification windows, etc. In addition to handles, it may have over-the-shoulder straps and straps configured to make a backpack of the assembly.

The bag and accessories can be of any shape--round, square, rectangular, or the like, and the container can have feet and even feet with rollers.

In good weather, only the bag container will be used to protect the bottom of the bag from dirt, etc. During inclement weather, the entire set of accessories would be used. As indicated previously, the cap and container can serve as a carrying or storage case for the system.

Now having described my invention, what I claim is:

1. A carrier system comprising a non-waterproof bag and a plurality of waterproof accessories forming a cover for said bag; the waterproof accessories comprising:

a bottom container adapted to enclose the bottom and a minor portion of the sides of said bag and for attachment thereto;

a cap adapted to fit over the top and a minor portion of the sides of said bag and for attachment to at least one of the said bag, the bottom container, and a sheath;

said sheath adapted to fit around a major portion of the sides of said bag and adapted for attachment to said bottom container and said cap to form a weather resistant cover for said bag; and said bag including means for attaching it to at least one of the bottom container, the sheath and the cap.

2. The carrier system of claim 1 wherein the bag has a handle means.

3. The carrier system of claim 1 wherein the bag includes pocket means and a bag closure means.

4. The carrier system of claim 1 wherein the bag and sheath include handle means.

5. The carrier system of claim 1 wherein at least one of the sheath and the cap includes a large logo-type design.

6. The carrier system of claim 1 including means for connecting the cap to the bottom container to form a storage container for the bag and the sheath.

7. The carrier system of claim 1 wherein said bag attaching means includes snap fasteners adapted to connect the bag to at least one of the waterproof accessories, and snap fastener means to connect elements of the waterproof accessories to each other.

8. The carrier system of claim 1 wherein said bag attaching means includes hook and pile fasteners to connect the bag to at least one of the waterproof accessories, and hook and pile fastener means to connect elements of the waterproof accessories to each other.

9. The carrier system of claim 1 including handle means wherein the strength of the bag is sufficient to substantially eliminate stretching of the bag and thereby protect the accessories from stress caused by pressure exerted by the contents of the bag when the bag is carried by its handle means.

10. The carrier system of claim 1 wherein the nonattached edges of the accessories are folded over and fused wherein the accessories have seams and wherein the seams of said accessories are fused.

11. The carrier system of claim 6 wherein the cap and bottom container are constructed of a nonflexible material.

12. The carrier system of claim 11 wherein the cap and bottom container are constructed of ABS plastic.

13. The carrier system of claim 11 wherein the cap and bottom container are constructed of polystyrene plastic.

14. The carrier system of claim 6 wherein at least the bag includes a large logo-type design.

15. The carrier system of claim 9 wherein the bag is made of cotton quilting.

16. The carrier system of claim 9 wherein the bag is made of a luggage fabric.

17. The carrier system of claim 9 wherein the bag is made of leather.

18. The carrier system of claim 9 wherein the bag includes pocket means and handle means and the top edges of the bag and the pocket means and handle means include an edging means.

19. The carrier system of claim 9 wherein the bag includes seams and the seams are sewn.

* * * * *